US006659735B2

(12) United States Patent
Kim

(10) Patent No.: US 6,659,735 B2
(45) Date of Patent: Dec. 9, 2003

(54) SCROLL COMPRESSOR

(75) Inventor: Su Chul Kim, Changwon (KR)

(73) Assignee: LG Electronics Inc. (KR)

( * ) Notice: Subject to any disclaimer, the term of this patent is extended or adjusted under 35 U.S.C. 154(b) by 0 days.

(21) Appl. No.: 10/059,832

(22) Filed: Jan. 30, 2002

(65) Prior Publication Data

US 2002/0102165 A1 Aug. 1, 2002

(30) Foreign Application Priority Data

Jan. 31, 2001 (KR) ..... 2001-4684

(51) Int. Cl.[7] ..... F04B 49/00

(52) U.S. Cl. ..... 417/310; 137/513; 137/521; 137/112

(58) Field of Search ..... 417/310, 440; 137/513, 521, 512.1–512.4, 512.15, 519, 527, 855, 856, 112; 418/55.1, 270

(56) References Cited

U.S. PATENT DOCUMENTS 4,560,330 A * 12/1985 Murayama et al. ..... 418/55
4,759,696 A * 7/1988 Ishiai ..... 418/55
5,088,905 A * 2/1992 Beagle ..... 418/55.1
5,090,880 A * 2/1992 Mashimo ..... 417/310
5,913,642 A * 6/1999 Boehler et al. ..... 406/171
5,941,270 A * 8/1999 Nogle ..... 137/112
6,095,765 A * 8/2000 Khalifa ..... 417/310
6,190,138 B1 * 2/2001 Hugenroth et al. ..... 417/310
6,273,691 B1 * 8/2001 Morimoto et al. ..... 418/15

FOREIGN PATENT DOCUMENTS

JP 57-157871 * 9/1982
JP 64-032092 * 2/1989

* cited by examiner

*Primary Examiner*—Cheryl J. Tyler
*Assistant Examiner*—Han L Liu
(74) *Attorney, Agent, or Firm*—Ostrolenk, Faber, Gerb & Soffen, LLP

(57) ABSTRACT

A scroll compressor that simplifies the structure of a valve and decrease the size of the entire compressor includes a casing having a first chamber into which a fluid is sucked and a second chamber at which compressed fluid is discharged, a driving unit housed inside the casing to generate a driving force, a compressing unit having a fixed scroll and an orbiting scroll connected to the driving unit by a rotational shaft to compress and discharge the fluid when the driving unit is operated. A valve assembly is rotatively installed to the upper surface of the fixed scroll, opening/closing a discharge hole at which the compressed fluid is discharged and opening/closing a passage connecting the first chamber and the second chamber.

10 Claims, 5 Drawing Sheets

SCROLL COMPRESSOR

BACKGROUND OF THE INVENTION

1. Field of the Invention

The present invention relates to a scroll compressor, and in particular to a scroll compressor which is capable of simplifying a structure of a valve, decreasing a size of a whole compressor and lowering a noise occurred in the valve by reducing the number of construction parts.

2. Description of the Prior Art

Generally, compressors can be divided into various kinds in accordance with compression methods, among them an air conditioning system required to be small-sized and lightweight mainly uses a scroll compressor.

FIG. 1 is a sectional view illustrating a scroll compressor in accordance with the prior art.

The scroll compressor in accordance with the prior art includes a casing 106 respectively connected to a suction pipe 102 at which a fluid is sucked, a discharge pipe 104 at which a compressed fluid is discharged and having a hermetically sealed certain space, a driving unit 108 placed at the lower portion of the casing 106 and generating a driving force, and a compressing unit 110 placed at the upper portion of the casing 106, connected to the driving unit 108 by a rotational shaft 112, compressing the fluid sucked through the suction pipe 102 and discharging it through the discharge pipe 104 by the rotation of the rotational shaft 112.

A supporting frame 114 is installed inside the casing in order to support the rotational shaft 112 rotatively and support the compressing unit 110, and a separation panel 120 is installed inside the casing 106 in order to divide the inner space of the casing 106 into a first chamber 116 putting a low pressure on a fluid and a second chamber 118 putting a high pressure on the fluid.

Because the driving unit 108 is constructed with a stator 122 fixed to the casing 106 and a rotor 124 installed to the inner circumference of the stator 122 and fixed to the rotational shaft 112, when power is applied to the stator 122, the rotor 124 is rotated by the mutual operation of the stator 122 and the rotor 124, accordingly the rotational shaft 112 is rotated.

The compressing unit 110 includes a fixed scroll 128 formed with a fixed vane 126 having an involute shape and fixed to the separation panel 120, and an orbiting scroll 132 formed as an orbiting vane 130 having an involute shape corresponding to vane 126 so as to have a certain compression space between the fixed vane 126 of the fixed scroll 128, supported by the supporting panel 114 so as to perform an orbiting motion and orbiting in the rotation of the rotational shaft 112.

A discharge passage 136 is formed at the center of the fixed scroll 128 in order to discharge the fluid compressed by the mutual operation of the fixed scroll 128 and the orbiting scroll 132 into the second chamber 118, a check valve 138 is installed to the upper portion of the discharge passage 136 in order to prevent the fluid discharged into the second chamber 118 from flowing backward into the first chamber 116, and a vacuum preventive valve 140 is installed to the side of the fixed scroll 128 in order to prevent the first chamber 116 from being in a vacuum state by flowing the fluid of the second chamber 118 to the first chamber 116 when the driving unit 108 is stopped or the suction pipe 102 is closed.

The check valve 138 is constructed with a valve body 142 combined to the central upper end portion of the fixed scroll 128 at which the discharge passage 136 is formed by a bolt and having a penetrated central portion so as to connect to the discharge passage 136, and a piston type valve member 144 installed inside the valve body 142 so as to be movable up and down in order to close the discharge passage 136 by a self weight.

In the check valve 138, when the fluid compressed by the mutual operation of the fixed scroll 128 and the orbiting scroll 132 is discharged into the discharge passage 136, the valve member 144 is lifted by a pressure of the discharged fluid. Herein, the compressed fluid flows into the second chamber 118 while the discharge passage 136 is opened and is discharged outside through the discharge pipe 104.

As depicted in FIG. 2, the vacuum preventive valve 140 includes a cylinder unit 150 formed at the side of the fixed scroll 128 so as to have a certain space, a valve spool 152 installed to the inner circumference of the cylinder unit 150 so as to be slidable, and an elastic member 158 engaged between the side surface of the valve spool 152 and the internal wall of the cylinder unit 150 and providing a certain elastic force to the valve spool 152.

Herein, the side of the cylinder portion 150 is opened so as to connect with the first chamber 118. And, the fluid compressed at the compression space between the fixed vane 126 and the orbiting vane 130 flows into the cylinder unit 150 through a first flow channel 154, and because the cylinder unit 150 is connected to the second chamber 118 by a second flow channel 156, the fluid inside the second chamber 118 flows into the cylinder unit 150.

A spring constant of an elastic member 158 is smaller than a pressure of the fluid flowing into the first flow channel 154.

In the vibration preventive valve 140, when the fluid compressed in the compression space puts to the side of the cylinder unit 150 through the first flow channel 154 and operates on the valve spool 152, the valve spool 152 is moved in the right direction in FIG. 2 by overcoming the elastic force of the elastic member 158, accordingly the closed state of the second flow channel 156 can be maintained.

In the closed state, when the operation of the orbiting scroll 132 is stopped due to the stopping of the driving unit 108, as depicted in FIG. 3, a hydraulic pressure acting on the valve spool 152 through the first flow channel 154 is removed, the valve spool 152 is moved in the left direction in FIG. 3 by the elastic force of the elastic member 158. Herein, because the second flow channel 156 and the first chamber 116 are connected by the movement of the valve spring 152, the high pressure fluid inside the second chamber 118 flows into the first chamber 116, accordingly the first chamber 116 and the second chamber 118 can keep a balance pressure.

And, when the driving unit 108 is operated in the closed state of the suction pipe 102, the hydraulic pressure acting on the valve spool 152 through the first flow channel 154 is removed, the valve spool 152 is moved in the left direction in FIG. 2, then, the second flow channel 156 and the second chamber 118 are connected each other, the fluid inside the second chamber 118 is supplied to the first chamber 116, accordingly it is possible to prevent the first chamber from being in a vacuum state.

However, in the conventional scroll compressor, because a check valve preventing a backward flow of a fluid and a vacuum preventive valve preventing a first chamber from being in a vacuum state are respectively installed to a fixed scroll, the structure is complicate, and because the two valves are respectively installed to the fixed scroll, a space for housing the valves has to be increased, accordingly the size of a whole compressor is increased.

In addition, because the structure of the compressor is complicate due to the vibration preventive valve and the check valve, production processes are intricate, accordingly a production cost is increased.

In addition, because a valve member of the check valve is formed as a piston type, the valve member is moved up and down inside the valve body in accordance with a pressure of a fluid, when a discharge pressure is unstable, the valve member generates a noise by being collided with the internal wall of the valve body or the upper surface of the fixed scroll.

SUMMARY OF THE INVENTION

In order to solve the above-mentioned problems, it is an object of the present invention to provide a scroll compressor which is capable of simplifying a structure of a valve, decreasing a size of a whole compressor and reducing a production cost by having a function for preventing a fluid from flowing backward and a function for preventing a compressor from being a vacuum state simultaneously with one valve.

It is another object of the present invention to provide a scroll compressor which is capable of lowering a noise occurred in a valve due to an unstable state of a discharge pressure of a fluid in the operation of the compressor.

In order to achieve the above-mentioned objects, a scroll compressor in accordance with the present invention comprises a casing having a hermetically sealed certain space divided into a first chamber at which a fluid is sucked and a second chamber at which a compressed fluid is discharged, a driving unit housed inside the casing and generating a driving force, a compressing unit including a fixed scroll and an orbiting scroll connected to the driving unit by a rotational shaft in order to compress and discharge the fluid when the driving unit is operated, and a valve assembly rotatively installed to the upper surface of the fixed scroll, opening/closing a discharge hole at which the compressed fluid is discharged and opening/closing a passage connecting the first chamber and the second chamber each other.

An inner diameter of the passage is smaller than an inner diameter of the discharge hole.

The valve assembly is constructed with a rod part hinge-connected to the fixed scroll and curved at a certain angle in two directions centering around a hinge-connected point, a hinge part formed between the rod part and the upper surface of the fixed scroll and supporting the rod part rotatively, a first valve part formed at the end of the rod part and opening/closing the discharge hole and a second valve part formed at the other end of the rod part and opening/closing the passage.

The rod part is rotatively installed to the upper surface of the fixed scroll by the hinge part and has a plate shape curved at a certain angle in two directions centering around the hinge part.

The hinge part is constructed with a hinge bracket perpendicularly projected from the upper surface of the fixed scroll and having a hinge hole at which a hinge pin is inserted and a hinge protrusion upwardly projected from the curved portion of the rod part and having a hinge hole at which the hinge pin is inserted.

The first valve part is extended from one end of the rod part and is formed as a circular flat plate shape in order to open/close the discharge hole.

The first valve part is formed so as to have a diameter greater than an inner diameter of the discharge hole.

The second valve part is extended from the other end of the rod part and is formed as a circular flat plate shape in order to open/close the passage.

The second valve part is formed so as to have a diameter greater than an inner diameter of the passage.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of a scroll compressor in accordance with the present invention will be described with reference to accompanying drawings.

There can be a plurality of embodiments of a scroll compressor in accordance with the present invention, hereinafter the most preferred embodiment will be described.

Figure 1:
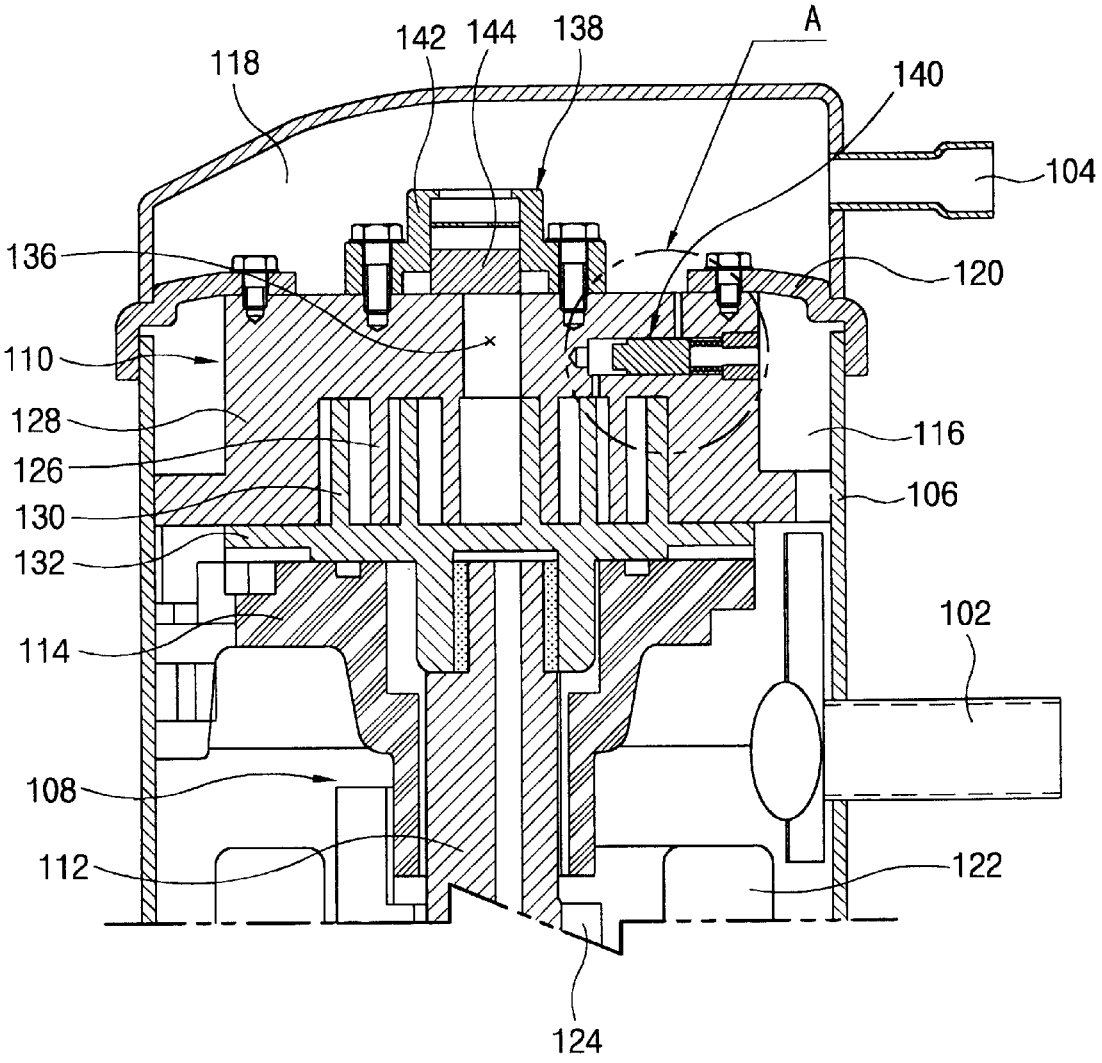
FIG.1 CONVENTIONAL ART
FIG. 1 is a sectional view illustrating a scroll compressor in accordance with the prior art.
Figure 2:
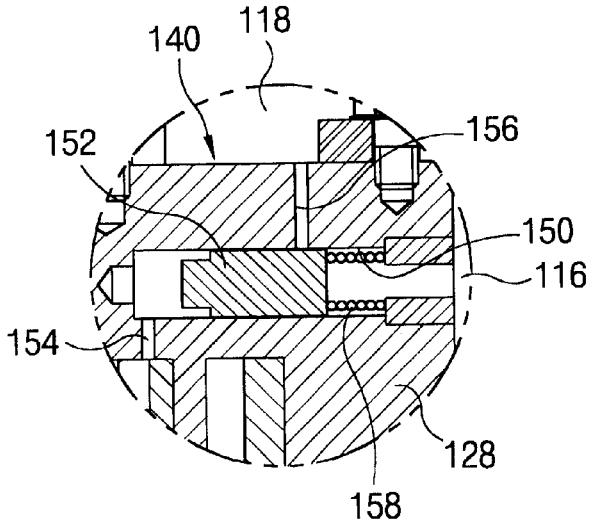
FIG.2 CONVENTIONAL ART
FIG. 2 is an enlarged sectional view of an A portion of FIG. 1 illustrating a structure of a vacuum preventive valve of the scroll compressor in accordance with the prior art.
Figure 3:
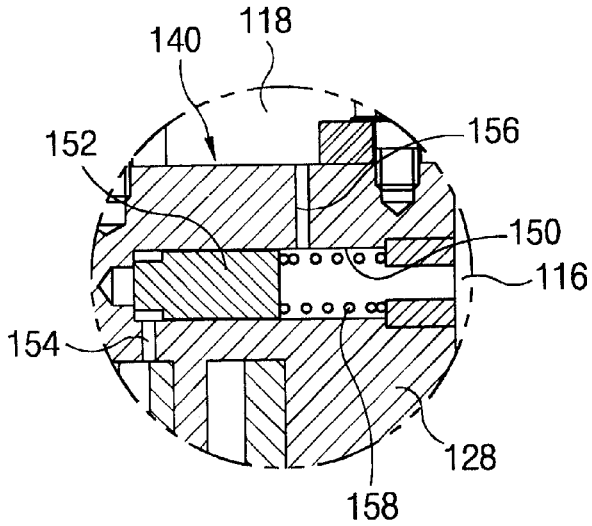
FIG.3 CONVENTIONAL ART
FIG. 3 is a state diagram illustrating an operation of a vacuum preventive valve of the scroll compressor in accordance with the prior art.
Figure 4:
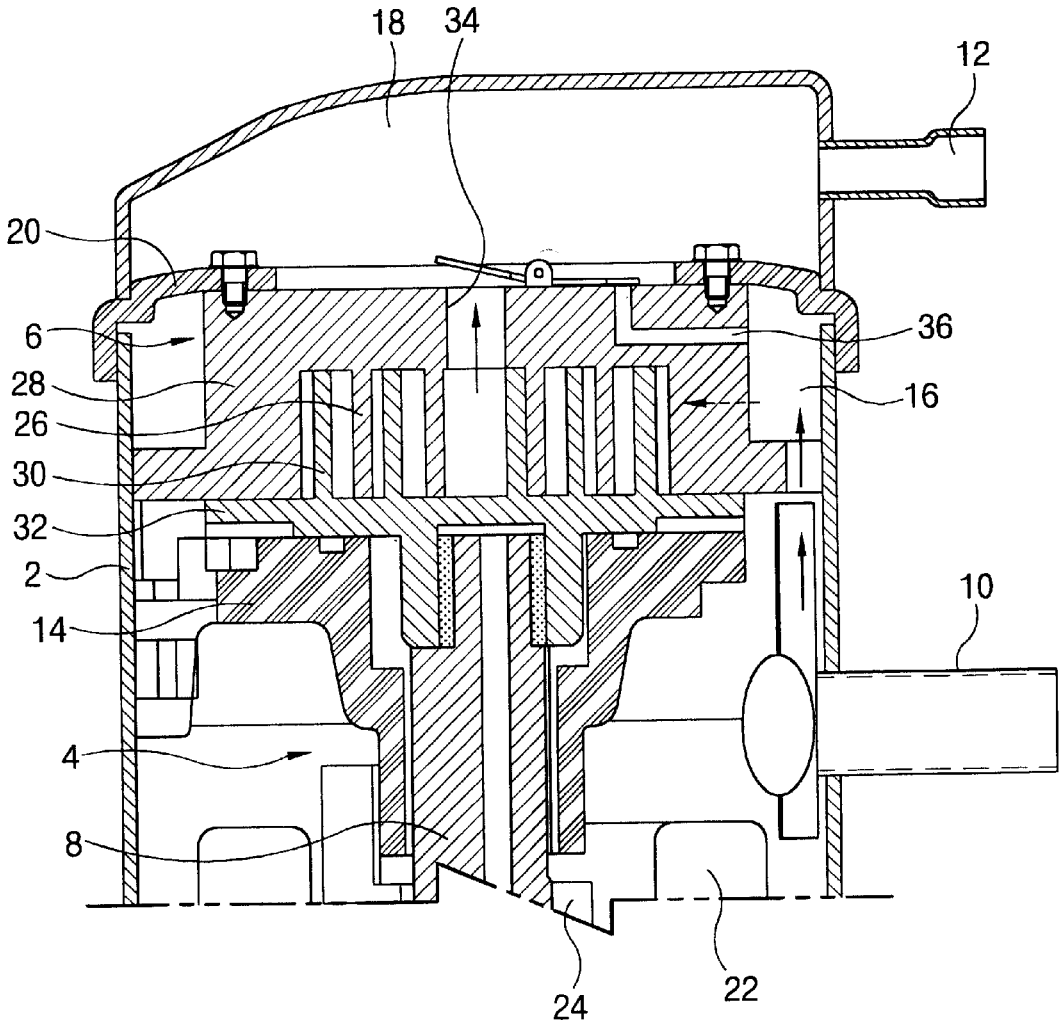
FIG. 4 is a sectional view illustrating a scroll compressor in accordance with the present invention.

FIG. 4 is a sectional view illustrating a scroll compressor in accordance with the present invention.

A scroll compressor in accordance with the present invention is constructed with a casing 2 having a hermetically sealed certain space, a driving unit 4 housed inside the casing 2 and generating a driving force, a compressing unit 6 connected with the driving unit 4 by a rotational shaft 8, compressing a fluid and discharging the fluid when the driving unit 4 is operated, and a valve assembly, etc. installed to the side of the compressing unit 6, preventing the fluid from flowing backward and preventing the internal space of the compressor from being in a vacuum state.

A suction pipe 10 at which a fluid is sucked and a discharge pipe 12 at which a compressed fluid is discharged are respectively connected to the side of the casing 2. The casing 2 houses a supporting frame 14 rotatively supporting the rotational shaft 8 and supporting the compressing unit 6 and a separation panel 20 dividing the internal space of the casing 2 into a first chamber 16 connected to the suction pipe 10 and putting a low pressure on a fluid and a second chamber 18 putting a high pressure on the fluid.

The driving unit 4 is constructed with a stator 22 fixed to the inner circumference of the casing 2 and a rotor 24 placed at the inner circumference of the stator 22 and fixed to the rotational shaft 22, when power is applied to the stator 22, the rotor 24 is rotated by the mutual operation of the stator 22 and the rotor 24, accordingly the rotational shaft 8 is rotated.

In the compressing unit 6, a fixed vane 26 having an involute shape is formed, an orbiting vane 30 having an involute shape corresponded to the fixed vane 26 is formed so as to have a certain compression space, and an orbiting scroll 32 supported by the supporting panel 14 so as to perform an orbiting motion and orbiting in the rotation of the rotational shaft 8.

A discharge hole 34 is formed at the central portion of the fixed scroll 28 in order to discharge the fluid compressed by the mutual operation of the fixed vain 26 and the orbiting vane 30 into the second chamber 18, and a passage 36 connecting the first chamber 16 and the second chamber 18 is formed at the side of the fixed scroll 28 so as to have a certain distance from the discharge hole 34 in order to flow the fluid inside the second chamber 18 into the first chamber 16. A valve assembly is installed to the upper surface of the fixed 28 in order to prevent the fluid from flowing backward by opening/closing the discharge hole 34 and flow a high pressure fluid inside the second chamber 18 into the first chamber 16 when the first chamber is in a vacuum state.

Figure 5:
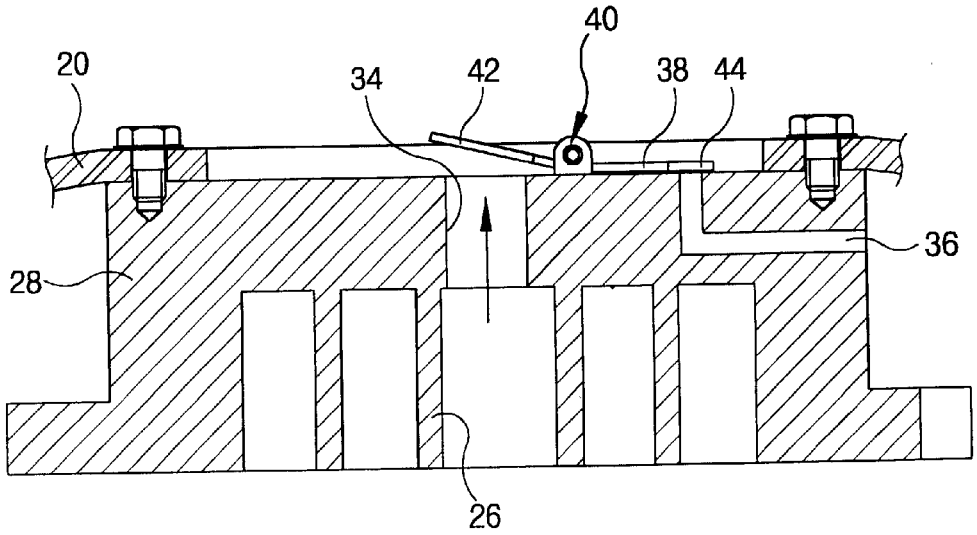
FIG. 5 is a sectional view illustrating a structure of a compressing unit of the scroll compressor in accordance with the present invention.
Figure 6:
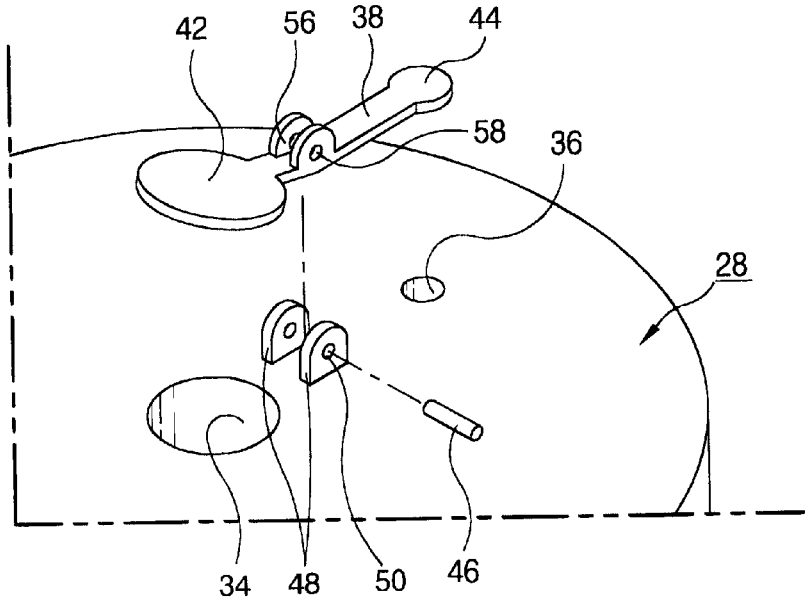
FIG. 6 is a disassembled perspective view illustrating a valve assembly of the scroll compressor in accordance with the present invention.
Figure 7:
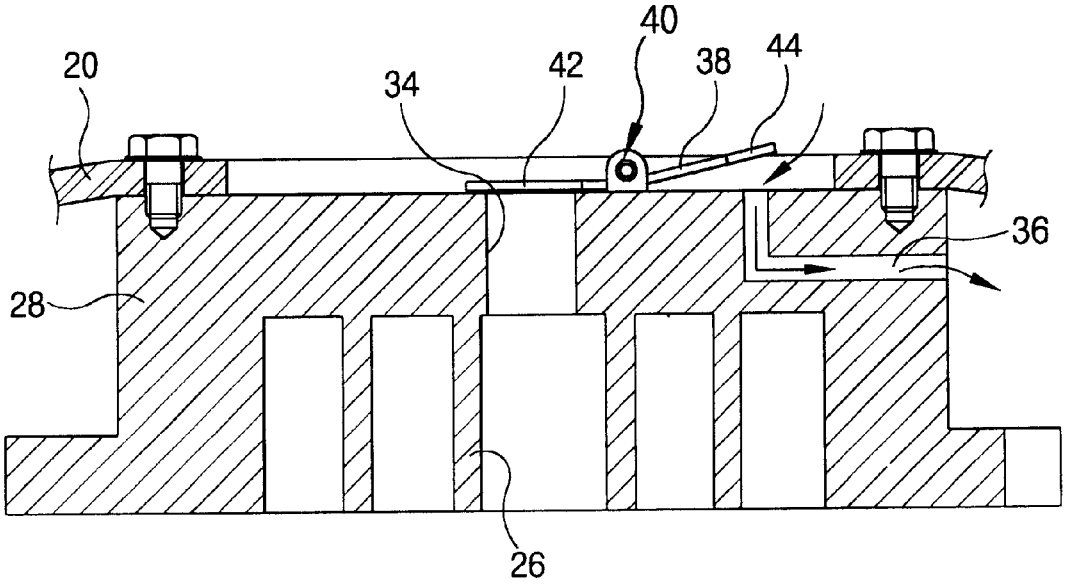
FIG. 7 is a state diagram illustrating an operation of the valve assembly of the scroll compressor in accordance with the present invention.

As depicted in FIGS. 5, 6 and 7, the valve assembly includes a rod part 38 hinge-connected to the upper side surface of the fixed scroll 28 and curved at a certain angle in two directions from the hinge connection portion, a hinge part 40 formed between the rod part 38 and the upper surface of the fixed scroll 28 in order to support rotatively the rod part 38, a first valve part 42 formed at the end of the rod part 38 and opening/closing the discharge hole 34, and a second valve part 44 formed at the other end of the rod part 38 and opening/closing the passage 36.

Herein, the rod part 38 is formed as a plate shape having a certain length and is curved at a certain angle in two directions centering around the hinge part 38.

And, the hinge part 40 is constructed with a hinge bracket 48 projecting from the upper surface of the fixed scroll 28 and having a hinge hole 50 at which a hinge pin 46 is inserted into, and a hinge protrusion 56 upwardly projecting from the curved portion of the rod part 38 and having a hinge hole 58 at which the hinge pin 46 is inserted into.

In more detail, after arranging the hinge hole 50 of the hinge bracket 48 and the hinge hole 58 of the hinge protrusion 56 at the same linear line, the hinge pin 46 is inserted into them, accordingly the central portion of the rod part 38 is rotatively installed to the upper side surface of the fixed scroll 28.

The first valve part 42 is extended from the end of the rod part 38, is formed as a circular flat plate shape having a diameter greater than a diameter of the discharge hole 34, is arranged so as to contact to the upper side surface of the discharge hole 34 and is rotated centering around the hinge part 40 in order to open/close the discharge hole 34.

In more detail, the first valve part 42 opens the discharge hole 34 by the pressure of the fluid compressed by the mutual operation of the fixed scroll 28 and the orbiting scroll 32 and prevents the fluid from flowing backward by closing the discharge hole 34 by being closely adhered to the upper surface of the fixed scroll 28 by a self weight when the driving unit 4 is stopped.

The second valve part 44 is extended from the other end of the rod part 38, is formed as a circular flat plate shape having a diameter greater than an inner diameter of the passage 36, is arranged so as to contact to the upper surface of the fixed scroll 28 having the passage 36 and opens/closes the passage 36 while being rotated centering around the hinge part 40.

In more detail, when the driving unit 4 is stopped, the second valve part 44 leaks the fluid inside the second chamber 18 to the first chamber 16 by opening the passage 36 in order to make the first chamber 16 and the second chamber 18 keep a balance pressure. In the closed state of the suction pipe 10, when the driving unit 4 is operated, the passage 36 is opened, accordingly it is possible to prevent the second chamber 18 from being in the vacuum state.

Herein, the diameter of the first valve part 42 is greater than the diameter of the second valve part 44, when the operation of the driving unit 4 is stopped and the hydraulic pressure acting on the first valve part 42 is removed, the first valve part 42 is operated in a direction closing the discharge hole 34 by the self weight, and the second valve part 44 is rotated together with the rotation of the first valve part 42 and is operated in a direction opening the passage 36.

The operation of the valve assembly of the scroll compressor in accordance with the present invention will be described.

When power is applied to the driving unit 4, the rotational shaft 8 is rotated by the mutual operation of the stator 22 and the rotor 24, the orbiting scroll 32 performs the orbiting motion by the rotation of the rotational shaft 8, accordingly the fluid sucking into the first chamber 16 through the suction pipe 10 is compressed. By the pressure of the fluid, the first valve part 42 is rotated centering around the hinge part 40, the discharge hole 34 maintains the opened state, the compressed fluid flows into the second chamber 18 and is discharged outside through the discharge pipe 12.

Herein, because the first valve part 42 is operated so as to open the discharge hole 34, the second valve part 42 maintains the state closing the passage 36.

In that state, when the driving unit 4 is stopped, the hydraulic pressure acting on the first valve part 42 is removed, the first valve part 42 is rotated centering around the hinge part 40 by the self weight, is closely adhered to the upper surface of the fixed scroll 28 and closes the discharge hole 34, accordingly it is possible to prevent the fluid inside the second chamber 18 from flowing backward into the first chamber 16.

And, according to the operation of the first valve part 42, the second valve part 44 is operated in the direction opening the passage 36, the fluid inside the second chamber 18 flows into the first chamber 16 through the passage 36, accordingly the first chamber 16 and the second chamber 18 can keep a balance pressure.

And, in the closed state of the suction pipe 10, when the driving unit 4 is operated, the first valve part 42 is closed, the second valve part 44 is opened, the fluid inside the second chamber 18 leaks to the first chamber 16, the leaked fluid is pressurized in the compressing unit 6, accordingly it is possible to prevent the first chamber 16 from being in a vacuum state.

The effect of the scroll compressor in accordance with the present invention will be described.

By forming a first valve part opening/closing a discharge hole and a second valve part opening/closing a passage as one body and hinge-connecting the body to the upper surface of a fixed scroll, a function for preventing a backward flow of a fluid and a function for preventing a vibration can be simultaneously performed, accordingly it is possible to simplify a structure, decrease a size of a compressor and reduce a production cost.

In addition, in a compression operation of a fluid by the operation of a driving unit, because a first valve part is formed as a flat plate shape, it does not collide with a discharge hole, accordingly it is possible to prevent a noise occurrence due to an unstable discharge pressure.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A scroll compressor, comprising:

a casing having a hermetically sealed certain space divided into a first chamber at which a fluid is sucked and a second chamber at which a compressed fluid is discharged;

a driving unit housed inside the casing and generating a driving force;

a compressing unit including a fixed scroll and an orbiting scroll connected to the driving unit by a rotational shaft in order to compress and discharge the fluid when the driving unit is operated; and a valve assembly rotatively installed to the upper surface of the fixed scroll, opening/closing a discharge hole at which the compressed fluid is discharged and opening/closing a passage connecting the first chamber and the second chamber;

wherein the valve assembly includes a rod part hinge-connected to the fixed scroll and curved in two directions centering around a hinge-connected point; a hinge part formed between the rod part and the upper surface of the fixed scroll and supporting the rod part rotatively; a first valve part formed at the end of the rod part and opening/closing the discharge hole; and a second valve part formed at the other end of the rod part and opening/closing the passage.

2. The scroll compressor of claim 1, wherein an inner diameter of the passage is smaller than an inner diameter of the discharge hole.

3. The scroll compressor of claim 1, wherein the rod part is rotatively installed to the upper surface of the fixed scroll by the hinge part and has a plate shape curved at a certain angle in two directions centering around the hinge part.

4. The scroll compressor of claim 1, wherein the hinge part is constructed with a hinge bracket perpendicularly projected from the upper surface of the fixed scroll and having a hinge hole at which a hinge pin is inserted and a hinge protrusion upwardly projected from the curved portion of the rod part and having a hinge hole at which the hinge pin is inserted.

5. The scroll compressor of claim 1, wherein the first valve part is extended from one end of the rod part and is formed as a circular flat plate shape in order to open/close the discharge hole.

6. The scroll compressor of claim 5, wherein the first valve part is formed so as to have a diameter greater than an inner diameter of the discharge hole.

7. The scroll compressor of claim 1, wherein the first valve part is formed so as to have a diameter greater than an inner diameter of the discharge hole.

8. The scroll compressor of claim 1, wherein the second valve part is extended from the other end of the rod part and is formed as a circular flat plate shape in order to open/close the passage.

9. The scroll compressor of claim 8, wherein the second valve part is formed so as to have a diameter greater than an inner diameter of the passage.

10. The scroll compressor of claim 1, wherein the second valve part is formed so as to have a diameter greater than an inner diameter of the passage.

* * * * *